US005520352A

United States Patent [19]

Prix et al.

[11] Patent Number: 5,520,352

[45] Date of Patent: May 28, 1996

[54] SEPARATING AND APPLYING APPARATUS FOR MATERIAL WEBS ON WINDING MACHINES

[75] Inventors: Volker Prix, Munich; Manfred Irsigler, Dinkelscherben, both of Germany

[73] Assignee: BASF Magnetics GmbH, Mannheim, Germany

[21] Appl. No.: 220,366

[22] Filed: Mar. 31, 1994

[30] Foreign Application Priority Data

Apr. 2, 1993 [DE] Germany ..... 43 10 900.4

[51] Int. Cl.[6] ..... B65H 35/04

[52] U.S. Cl. ..... 242/527.3; 242/533.4

[58] Field of Search ..... 242/527.3, 527.4, 242/532.3, 533.4, 533.5, 533.6

[56] References Cited

U.S. PATENT DOCUMENTS

| | | | |
|---|---|---|---|
| 3,086,725 | 4/1963 | Zernov | 242/533.4 X |
| 3,497,150 | 2/1970 | Harmon | 242/533.4 X |
| 3,733,035 | 5/1973 | Schott, Jr. | 242/533.5 X |
| 3,782,665 | 1/1974 | Byrt et al. | 242/527.4 |
| 4,488,687 | 12/1984 | Andreasson | 242/527.3 |
| 4,530,265 | 7/1985 | Lee et al. | 83/337 |
| 4,541,583 | 9/1985 | Forman et al. | 242/527.3 |
| 4,550,882 | 11/1985 | Hutzenlaub et al. | 242/532.3 X |
| 4,695,004 | 9/1987 | Grossmann et al. | 242/532.3 X |
| 4,728,050 | 3/1988 | Luttge et al. | 242/527.3 |
| 4,842,209 | 6/1989 | Saukkonen | 242/527.3 |
| 5,251,836 | 9/1993 | Pack | 242/527.3 |

FOREIGN PATENT DOCUMENTS

| | | |
|---|---|---|
| 067051 | 12/1982 | European Pat. Off. . |
| 132390 | 1/1985 | European Pat. Off. . |
| 363295 | 4/1990 | European Pat. Off. . |
| 2168761 | 8/1973 | France . |
| 2213897 | 8/1974 | France . |
| 2418409 | 4/1974 | Germany . |
| 60013 | 2/1970 | Luxembourg . |

*Primary Examiner*—Daniel P. Stodola
*Assistant Examiner*—William A. Rivera
*Attorney, Agent, or Firm*—Keil & Weinkauf

[57] ABSTRACT

An apparatus for the separating and renewed applying of an incoming material web on winding machines to a winding sleeve, a separating knife and an applying brush, fixedly connected to the latter, being swivelled into the path of the material web for separating, and the separating knife being accelerated by a hydraulically driven motor, controlled by a stepping control motor, by means of a shaft at an angle of up to 130°, whereupon the separating operation is performed at from 230° to 260° and the shaft comes to a standstill again after about a further 90°. In this way, transverse separating of a material web is possible even at high speeds. In order to avoid deformations of the separating knife, the shaft of the hydraulic motor is provided with a compensating shaft.

12 Claims, 3 Drawing Sheets

SEPARATING AND APPLYING APPARATUS FOR MATERIAL WEBS ON WINDING MACHINES

Figure 1:
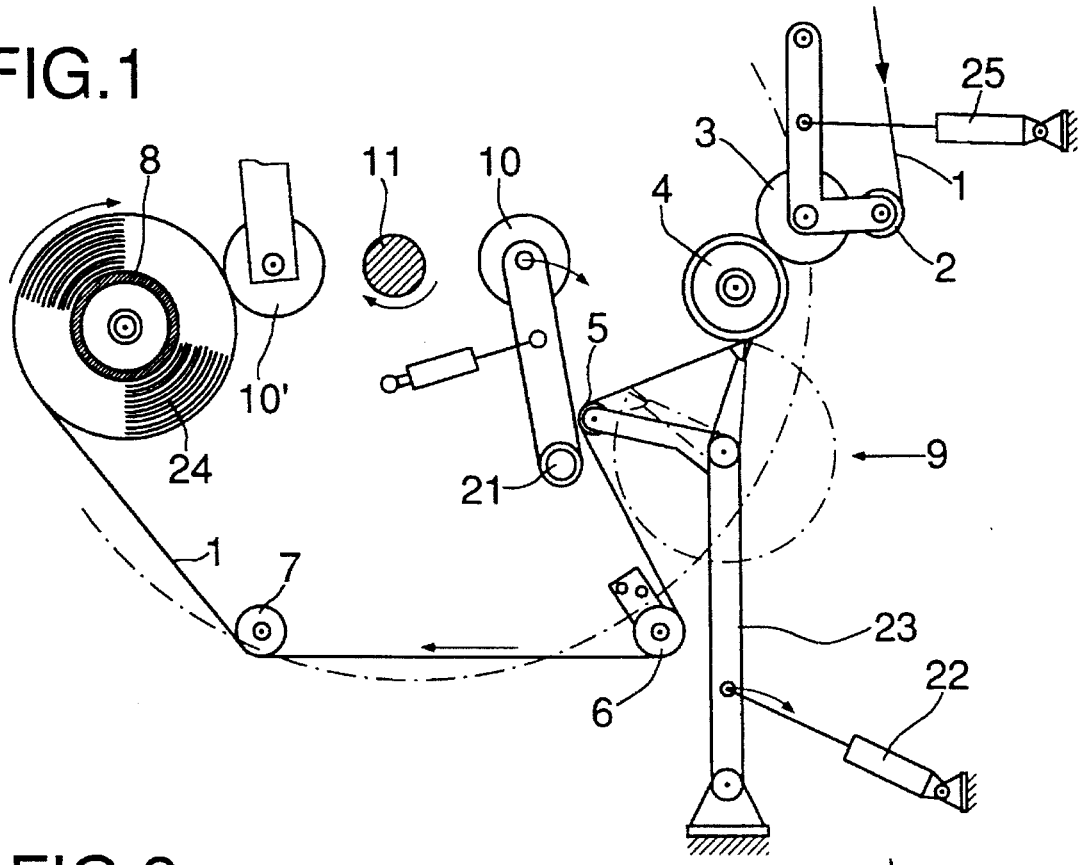

The invention relates to an apparatus for separating and renewed applying of an incoming material web on winding machines to a winding sleeve, which is driven in rotation by means of a shaft, the incoming material web being pressed against the winding sleeve by means of a deflection roller partially wrapped around by the material web, and the outgoing material web being separated after leaving the winding sleeve by means of a separating knife which extends transversely to the path of the material web, can be moved into the path of the web and can be driven by an energy storage mechanism, and the new beginning of the web being applied by means of an applying brush which extends transversely to the material web and is fixedly connected to the separating knife, the separating knife being accelerated with respect to the running material web such that its speed is greater than the running speed of the material web.

During the winding up of material webs, in particular by a multiple winding machine, for example what is known as a turret winder, it is important to lay the web around an empty winding sleeve as quickly as possible in order to avoid wastage from the finish-wound roll. After the transverse separating of the material web, the new beginning of the web is to be applied to the empty winding sleeve without any creases. Transverse cutting and applying apparatuses of this type are known from the prior art. An apparatus of the generic type mentioned at the beginning is described in DE-A 4,107,127 of the same applicant. In the case of this apparatus, the separating knife is held on both sides by guide bands, which run over rotatable deflection rollers, and in this arrangement an electric motor drives by means of a spindle a flywheel mass which, by means of a flange-mounted coupling, sets in accelerated rotation the rollers connected to it and, by means of the guide bands, feeds the separating knife to the separating point in an accelerated movement.

Other transverse cutting and applying apparatuses operate with a fixedly mounted smooth or serrated swivel knife, which strikes into the web to be separated and is driven electrically or pneumatically. According to DE-A 2,418,409, in the case of the outgoing web, a deflection roller is pressed by means of a swivel frame against the web between the empty winding sleeve and the full roll such that the web wraps around the empty winding sleeve by more than half the circumference, whereupon the material web is separated by a serrated separating knife, which is swivel-mounted on the spindle of the deflection roller and is driven by a torsion-bar spring, and in this arrangement the separating knife bears on the side facing away from the deflection roller a brush which brushes the web against the empty winding sleeve during the swivelling movement of the separating knife.

In DE-A 2,232,336 a corresponding apparatus is described, the separating element being driven by a pneumatic or hydraulic drive by means of a toothed rack and a toothed segment, the outgoing web being separated between empty winding sleeve and a deflection element, the separating element being swivelled coaxially with respect to the winding sleeve and, subsequently, the beginning of the web being pressed against the winding sleeve by an air box connected to the separating element. Furthermore the prior art discloses applying systems in which the separating apparatuses cut on the winding sleeve and require special winding sleeves with cutting grooves on the core. However, in this case, during the course of time the cutting operation has the effect that the core suffers damage, which together with the grooves in the core causes deformations in the material web in the roll.

It is an object of the present invention to provide an apparatus of the generic type mentioned at the beginning which permits reliable severing of a running material web and creaseless applying of the new beginning of the web on the winding sleeve, even at high web speeds, and in which arrangement in particular the units required for driving the separating knife and the applying brush also remain as free from wear as possible, in comparison with the previously described prior art, and operate with the minimum of moving parts and with low weight of these parts.

We have found that this object is achieved by an apparatus for the separating and renewed applying of an incoming material web (1) on winding machines to a winding sleeve (4), which is driven in rotation by means of a shaft, the incoming material web being pressed against the winding sleeve by means of a deflection roller partially wrapped around by the material web, and the outgoing material web being separated after leaving the winding sleeve by means of a separating knife which extends transversely to the path of the material web, being moved into the path of the web and being driven by an energy storage mechanism, and the new beginning of the web after separating of the latter being applied by means of an applying brush (13) which extends transversely to the material web and is fixedly connected to the separating knife, the separating knife (12) being accelerated with respect to the running material web such that its speed is greater than the running speed of the material web, wherein the separating knife (12) is connected to a shaft (16) which, actuated by a hydraulic motor (17), being driven in rotation in the web-running direction, and the radius of the separating knife and that of the applying brush being dimensioned such that the applying brush (13) applies the new beginning of the web over an angle of from 40° to 90° on the circumference of the winding sleeve, while the separating knife does not quite touch the winding sleeve. Further details of the invention emerge from the subclaims, the drawings and the description.

Figure 2:
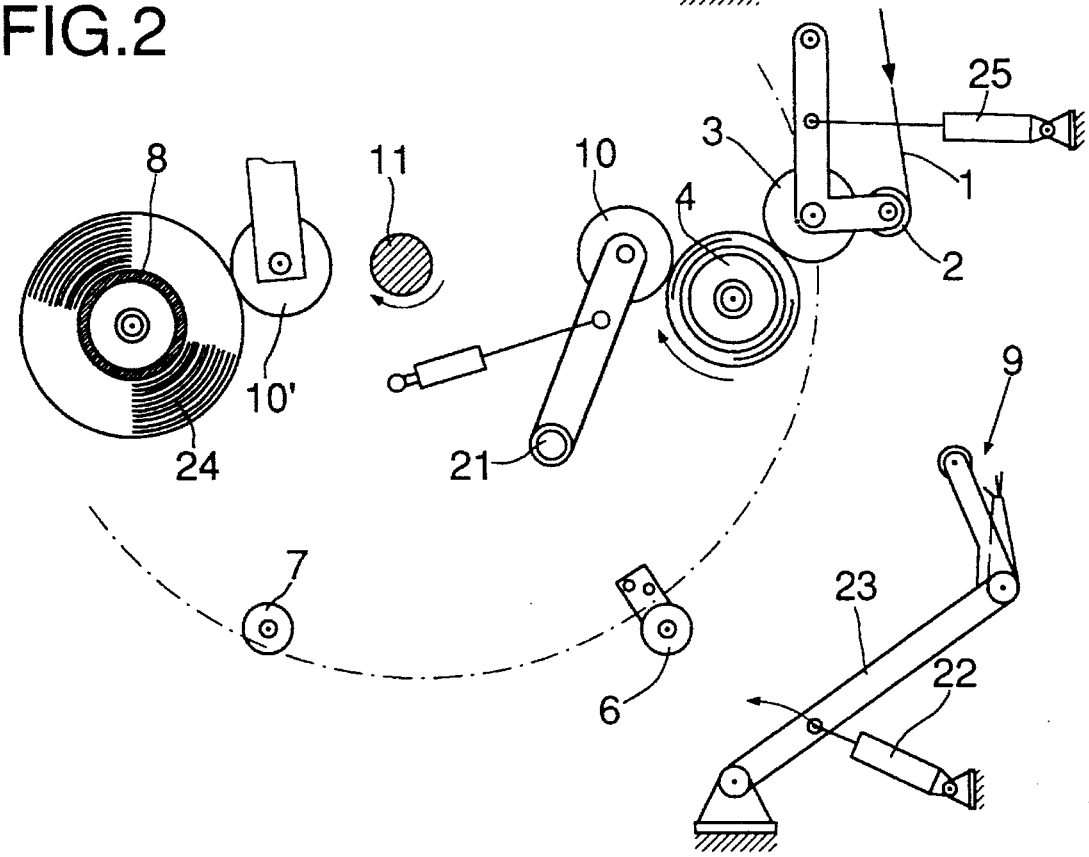
Figure 3:
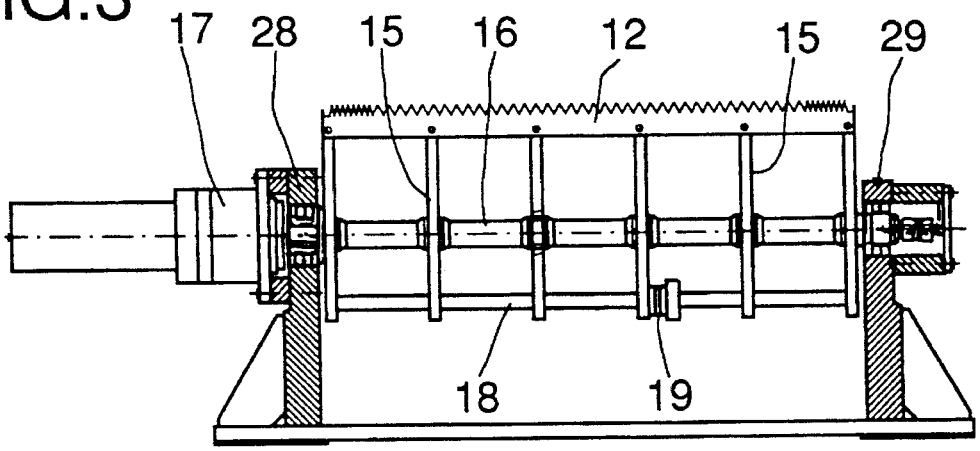
Figure 4:
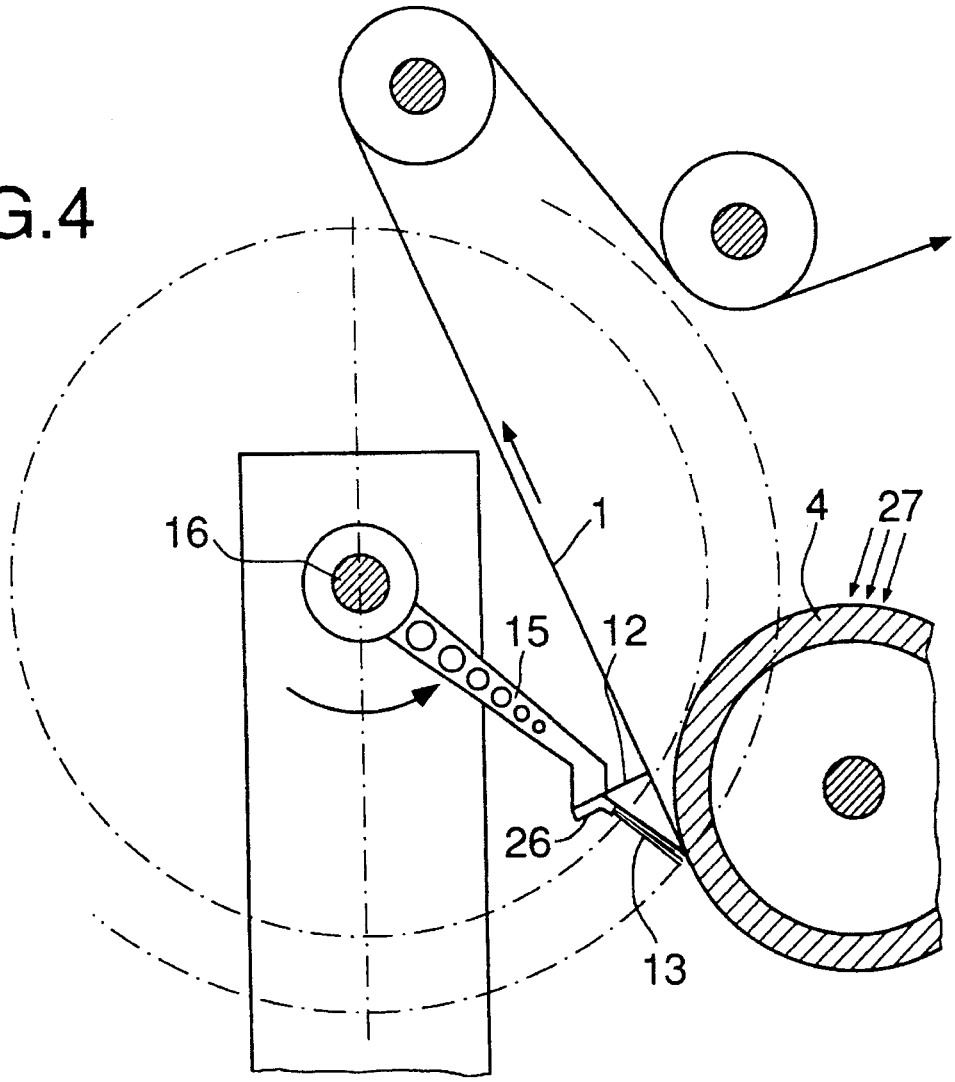

The invention is explained in more detail below with reference to the drawings, in which:

FIG. 1 shows the diagrammatic drawing of a turret winder having the separating and applying apparatus according to the invention, at the moment of the separating operation FIG. 2 shows a corresponding diagram during the winding up of the material web on the winding sleeve, after the separating operation FIG. 3 shows an axial section through the separating apparatus FIG. 4 shows a radial section through the separating apparatus according to FIG. 3

Figure 5:
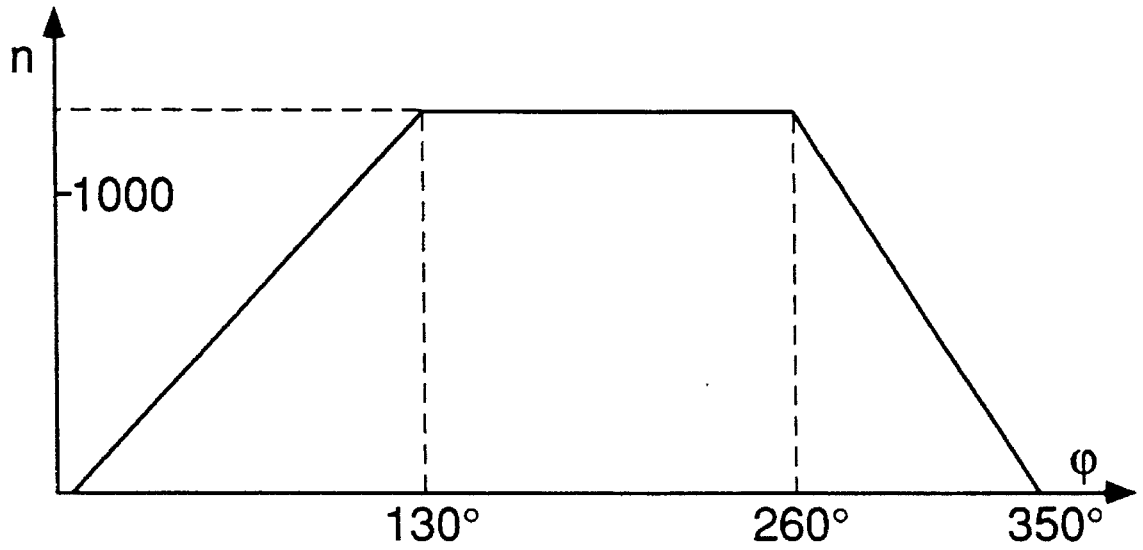

FIG. 5 shows the rotational speed of the drive motor over time, or against the variation in angle.

The apparatus according to the invention is explained in more detail by the example of what is known as a turret winder, although the invention is not restricted in any way to this specific winding apparatus but can be applied to all possible winding and separating apparatuses known from the prior art.

FIG. 1 shows the separating and applying apparatus at the moment of the separating operation. A preferably coated material web (1) runs via a deflection roller (2) and what is known as an outer contact roller (3) onto the winding sleeve (4) and wraps around the latter by about one quarter of its circumference. After leaving the winding sleeve, the material web is wound up via further deflection rollers (5, 6, 7) on a further winding sleeve (8). The entire apparatus is rotatable in the direction of the arrow with the point of rotation (11). The separating and applying apparatus (9), still to be described in more detail, can be swivelled into the apparatus described by means of a cylinder (22) and via a lever (23). Once the desired diameter of the roll (24) has been reached on the winding sleeve (8), the separating and applying apparatus (9) is swivelled in, the material web (1) is transversely separated, as described in more detail further below, approximately at the point where it leaves the still empty winding sleeve (4), and is applied to the winding sleeve (4) by means of an applying brush, fixedly connected to the separating knife, so that the newly produced beginning of the web is wound up on this winding sleeve. The remaining web is wound up on the winding sleeve (8), this winding sleeve is braked, the full roll is taken off and a new empty winding sleeve (not drawn) is fitted onto the winding spindle.

Immediately after the separating operation, the separating and applying apparatus (9) is swivelled away again, so that it remains in the position as indicated in FIG. 2. At the same time, the inner contact roller (10) is swivelled about the point of rotation (21) such that it lies against the circumference of the winding sleeve (4) as the inner contact roller as indicated in FIG. 2, and thus promotes smooth winding up of the material web.

When, as described above, a new empty winding sleeve has been fitted on at the position (8) and when, subsequently, virtually the full winding circumference has been reached on the winding sleeve (4), the outer contact roller (3), lying against the winding sleeve (4), is swivelled away together with the deflection roller (2) by means of the pushing cylinder (25), and the turret winder turns through 180° about the spindle of rotation (11), the core sleeve (4) drawing the material web (1) with it, the inner contact roller (10) continuing to lie against the winding sleeve (4) during the swivelling operation until, after completion of the 180° turn, the prepared empty winding sleeve has reached the position of the original winding sleeve (4) and the latter has arrived, while the winding-up operation continues to proceed, in the position like the winding sleeve (8) with the roll (24). After the end of the winding operation, the outer contact roller (3) is swivelled into place again.

Subsequently, when the roll has reached its full size in the position (8), a renewed separating operation begins, in which first of all the inner contact roller (10) is swivelled away and then the separating and applying apparatus (9) is swivelled together with the deflection roller (5) into the path of the web.

The features essential for the invention of the separating and applying apparatus (9) are now explained with reference to FIGS. 3 and 4. The knife (12) for transversely separating the web is fixedly connected to a rotatable shaft (16). The length of the knife is somewhat greater than the width of the material web (1). As the figures show, the shaft is connected via lever (15) to the knife (12) by means of a fastening device (26), the knife being aligned at a certain angle with respect to the material web (1). This angle is preferably about 90°. Also located on the fastening device is the applying brush (13), which describes a somewhat greater radius than the knife (12). The shaft (16) with the knife (12) rotates in the direction of the arrow in the same sense as the web-running direction; the circumferential speed of the knife (12) is greater than the web speed of the material web (1), it is at least 1.5 times as great. As a result, the separating and applying apparatus overtakes the material web during rotation of the shaft, so that the applying brush can brush the material web against the surface of the winding sleeve (4). As FIG. 4 shows, in this case the ratio of the radii of knife (12) and brush (13) and their respective distance from the winding sleeve (4) is dimensioned such that the free end of the knife is still just away from the surface of the winding sleeve (4) and the free end of the applying brush fixes the newly produced beginning of the web on the winding sleeve at an angle of from 40° to 90°. In this case, at the moment of transverse cutting, the applying brush lies against the material web approximately at the point where it leaves the winding sleeve.

The surface of the winding sleeve may be subjected to adhesive or water by means of a spraying apparatus (27) (not represented in any more detail) for easier adhesive attachment of the web. Similarly, it is also possible, as described for example in the parallel application OZ 0078/6126 of the applicant, to produce the winding sleeve (4) from a plastics material having adhesion. The shaft (16) with the knife (12) is driven by a hydraulic torque amplifier (17), to which it is directly connected. Motor and shaft are connected directly to each other, that is without coupling elements, for example by pressing together correspondingly shaped conical parts of motor shaft and shaft (16) or by other measures known from the prior art. The shaft (16) is mounted on both sides (28, 29).

The hydraulic motor is operated at an operating pressure of about 160 bar, and said motor is controlled by means of an electrical stepping motor (1000 steps correspond to 360°). Manufacturers of such motors are, for example, the company SIG (Schweizer Industrie Gesellschaft). The entire motor-shaft-knife arrangement is designed to be of low mass, inter alia by using lightweight metal for shaft and lever, in such a way that, as FIG. 5 reveals, to achieve the full rotational speed, the separating knife is turned merely by an angle of about 130°, and then this speed is maintained for about an angle of rotation of 130°, the separating operation being performed during this time, and subsequently the knife speed is braked again to zero over an angle of about 90°.

Subsequently, the separating apparatus (9) is swivelled away and, during this time, the pivot arm is turned back slowly to its original position, which is marked for example by a fork-type light barrier, so that the separating and applying apparatus is prepared for the next separating operation.

To compensate for the enormous forces of acceleration due to the knife, a compensating shaft (18) is seated on the shaft (16), lying opposite the knife (12), likewise connected by means of the levers (15). This shaft (18) serves as a counter-weight to the knife (12) and can be balanced by shims (19), which are arranged alongside a connecting arm to the shaft (18), such that the shaft (16) is not deformed during the rotation of the knife and consequently the knife (12) executes a linear cut through the material web.

It has been found that, with the separating and applying apparatus according to the invention, a satisfactory cut and a satisfactory application of the beginning of the web is possible even at web speeds of 800 m/min. This is a way of making possible a largely automated winding, separating and applying process for fast-running material webs which has very high production reliability, requires no interruptions in production and is largely free from wear.

We claim:

1. Apparatus for separating and renewed applying of a material web running along a path in a direction, on winding machines to a winding sleeve which is driven in rotation, incoming material web being pressed against the winding sleeve by means of a deflection roller which is partially wrapped around by the material web, and outgoing material web being separated after leaving the winding sleeve by means of a separating knife which extends transversely to the path of the material web, said separating knife being rotated into the path of the material web and being driven by an energy storage mechanism to sever the material web and form a new beginning of the material web, and the new beginning of the material web after separating of the material web being applied by means of an applying brush which extends transversely to the material web and is attached to the separating knife, the separating knife being accelerated rotationally in relation to the running material web such that the rotational speed of the knife is greater than the running speed of the material web, wherein the separating knife is connected to a shaft which is actuated by a hydraulic motor being driven in rotation in the web-running direction, and the radii of the circles described by the separating knife and the applying brush as they rotate being dimensioned such that the applying brush applies the new beginning of the material web over an angle of from 40° to 90° on the circumference of the winding sleeve, while the separating knife does not quite touch the winding sleeve as it rotates thereby.

2. The apparatus defined in claim 1, wherein the hydraulic motor accelerates the shaft by means of a stepping control mechanism over an angle of rotation of about 130°, and wherein the position at which the separating operation takes place is reached after about 230° and the rotation is brought to a standstill after about 350°, the shaft subsequently being returned slowly to the starting position.

3. The apparatus as defined in claim 1, wherein the circumferential speed of the separating knife and of the applying brush is at least 1.5 times the running speed of the material web.

4. The apparatus as defined in claim 1, wherein the angle between knife and sheet at the moment of cutting is about 90°.

5. The apparatus as defined in claim 1, wherein the winding sleeve is wrapped around by the material web before the cut by about one quarter of its circumference.

6. The apparatus as defined in claim 1, wherein at the moment of transverse separating of the material web the applying brush lies against the winding sleeve.

7. The apparatus as defined in claim 1, wherein the separating knife, the applying brush and their shaft are swivelled into the path of the material web immediately before the separating operation and are swivelled out again immediately after applying the new beginning of the web to the winding sleeve.

8. The apparatus as claimed in claim 1, wherein, at least during the winding up of a tape roll, there lies against each winding sleeve a pressing roller which is swivelled away.

9. The apparatus as claimed in claim 1, wherein the surface of the winding sleeve has adhesive properties.

10. The apparatus as claimed in claim 1, wherein the surface of the winding sleeve is sprayed with an adhesive immediately before the separating operation.

11. The apparatus as defined in claim 1, wherein a compensating shaft, which is adjusted in its mass, is attached to the shaft opposite the separating knife, so as to serve as a counter-weight to the separating knife.

12. The apparatus as defined in claim 1, wherein the surface of the winding sleeve is sprayed with water immediately before the separating operation.

* * * * *